US005431287A

United States Patent [19]

Knox

[11] Patent Number: 5,431,287

[45] Date of Patent: Jul. 11, 1995

[54] SEPARATOR SCREEN FEEDER

[75] Inventor: Pete D. Knox, Union, Ky.

[73] Assignee: Sweco, Inc., Florence, Ky.

[21] Appl. No.: 221,824

[22] Filed: Mar. 31, 1994

[51] Int. Cl.[6] ..... B07B 1/55

[52] U.S. Cl. ..... 209/250; 209/254; 209/268

[58] Field of Search ..... 209/243, 234, 254, 268, 209/240, 380, 321, 312, 250, 323; 210/772, 199, 209, 384, 391, 393, 405, 409, 411–413, 456

[56] References Cited

U.S. PATENT DOCUMENTS

| | | | |
|---|---|---|---|
| 672,981 | 4/1901 | Jessup | 209/254 X |
| 1,021,248 | 3/1912 | Gross et al. | 210/405 X |
| 1,159,962 | 11/1915 | Lamb | 209/254 X |
| 2,737,295 | 3/1956 | Symons | 209/254 |
| 2,826,370 | 3/1958 | Weston | 209/268 X |
| 3,024,911 | 3/1962 | Janson | 209/268 |
| 3,261,368 | 7/1966 | Owens et al. | 209/254 X |
| 3,501,002 | 3/1970 | Talley, Jr. | 209/240 |
| 3,666,095 | 5/1972 | Krynock et al. | 209/254 |
| 3,796,312 | 3/1974 | Krolopp et al. | 209/312 |
| 3,827,567 | 8/1974 | Rundquist | 209/250 X |
| 3,828,930 | 8/1974 | Elmer et al. | 210/405 X |
| 3,899,417 | 8/1975 | Morris | 209/243 |
| 3,928,188 | 12/1975 | Link et al. | 209/250 |
| 4,053,408 | 10/1977 | O'Cheskey | 210/79 |
| 4,152,255 | 5/1979 | Musschoot | 209/234 |
| 4,251,354 | 2/1981 | Lower | 209/240 |
| 4,332,680 | 6/1982 | O'Cheskey | 210/143 |
| 4,512,880 | 4/1985 | Connolly | 209/250 |
| 4,613,432 | 9/1986 | Racine et al. | 209/254 |
| 4,692,240 | 9/1987 | Arbuthnot et al. | 209/254 |
| 4,820,407 | 4/1989 | Lilie | 209/397 |
| 5,051,171 | 9/1991 | Hukki | 209/323 |
| 5,213,216 | 5/1993 | Suehiro et al. | 209/254 X |
| 5,255,789 | 10/1993 | Janssens et al. | 209/319 |
| 5,265,730 | 11/1993 | Norris et al. | 209/326 |
| 5,271,504 | 12/1993 | Bowen et al. | 209/316 |

FOREIGN PATENT DOCUMENTS

| | | | |
|---|---|---|---|
| 0016057 | 1/1988 | Japan | 209/254 |
| 2171930 | 9/1986 | United Kingdom | 209/254 |

*Primary Examiner*—D. Glenn Dayoan
*Attorney, Agent, or Firm*—Lyon & Lyon

[57] ABSTRACT

A vibratory screen separator system having a moving manifold, angled feed nozzles, and angled spray nozzles. The spray nozzles and the feed nozzles are attached to the bottom of the manifold, and the manifold moves back and forth over the screen. The feed nozzles evenly distribute the material to be separated across the screen. The spray nozzles clean the screen before each pass by the feed nozzles.

26 Claims, 5 Drawing Sheets

SEPARATOR SCREEN FEEDER

BACKGROUND OF THE INVENTION

The field of the present invention is separators employing screens.

Screen systems have long been employed to separate solids from liquids and solids of different sizes by passage over and through wire mesh screens. The screens can be rectangular or circular. Typically, the screens are drawn taunt, positioned horizontally, and a material to be separated is propelled at the screen. One component of the material passes through the screen, and a second component of the material floats over the screen to a discharge point. Often, the screen is vibrated to increase the separation rate.

Efforts to increase the separation rate, encounter increased difficulties with screen wear, impingement screen blinding, screen stretching, and screen fatigue. Impingement screen blinding occurs where the feed stream continuously hits the same spot on the screen. The flow then moves horizontally from the point of impact providing continuing inefficient screening which progessively gets worse as screen blinding increases. An effective blind area on the screen exists because a layer of flow, typically solids, constantly covers the screen, reducing the flow rate through and over the screen.

To a certain extent, screen wear, screen stretching, and screen fatigue are expected conditions, but they become special problems when localized. Excessive wear on one portion of the screen can result in early failure. For example, when a screen is fed centrally, wear, stretching, and fatigue become localized in the center of the screen; and the problem of impingement screen blinding tends to occur in the center of the screen. Material has also been fed across the entire surface of the screen, but the foregoing problems can still exist because the flow of material to the feed points on the screen is continuous. As the flow rate of the material is increased, these problems are intensified.

SUMMARY OF THE INVENTION

The present invention is directed to a screen separator providing effective feed distribution and material flow over the screen.

In a first, separate aspect of the invention, a vibratory screen is placed below an influent feeder having a manifold. The manifold travels over the screen such that the feed points to the screen are constantly changing. Thus, impingement screen blinding and the localization of wear, stretching, and fatigue are avoided.

In a second, separate aspect of the invention, a movable manifold is again positioned over a vibratory screen. A plurality of spray nozzles ejecting cleaning fluid are attached to the manifold. The spray nozzles clean the screen as the manifold travels over the screen. Therefore, the material may be distributed to a clean feed point on the screen. Thus, the problem of impingement screen blinding is eliminated or reduced. As a further feature, the feed nozzles and the spray nozzles may be angled such that they propel the material and cleaning fluid respectively in the direction of the screen's discharge. Therefore, the material more rapidly floats over the screen and out the screen's discharge. Thus, the screen is cleaned at a faster rate, and the flow rates can be increased.

In a third, separate aspect of the invention, a method for separation is employed. A traveling manifold is movably mounted above a vibratory screen. Feed nozzles propel influent and spray nozzles propel a cleaning fluid at the screen. Because the influent is distributed by a moving manifold, the feed points are constantly changing. Therefore, impingement screen blinding, localized wear, fatigue, and stretching are reduced or eliminated.

In a fourth, separate aspect of the invention, a movable manifold is again positioned over a vibratory screen. The manifold has a forward stroke and a backward stroke. The forward stroke moves in the direction of the screen's discharge and is slower than the backward stroke. Thus, the manifold spends more time moving toward the screen's discharge, and material is floated off the screen more rapidly.

Accordingly, it is an object of the present invention to provide an improved screen separator having a traveling manifold. Other and further objects and advantages will appear hereinafter.

DETAILED DESCRIPTION OF TEE PREFERRED EMBODIMENT

Figure 1:
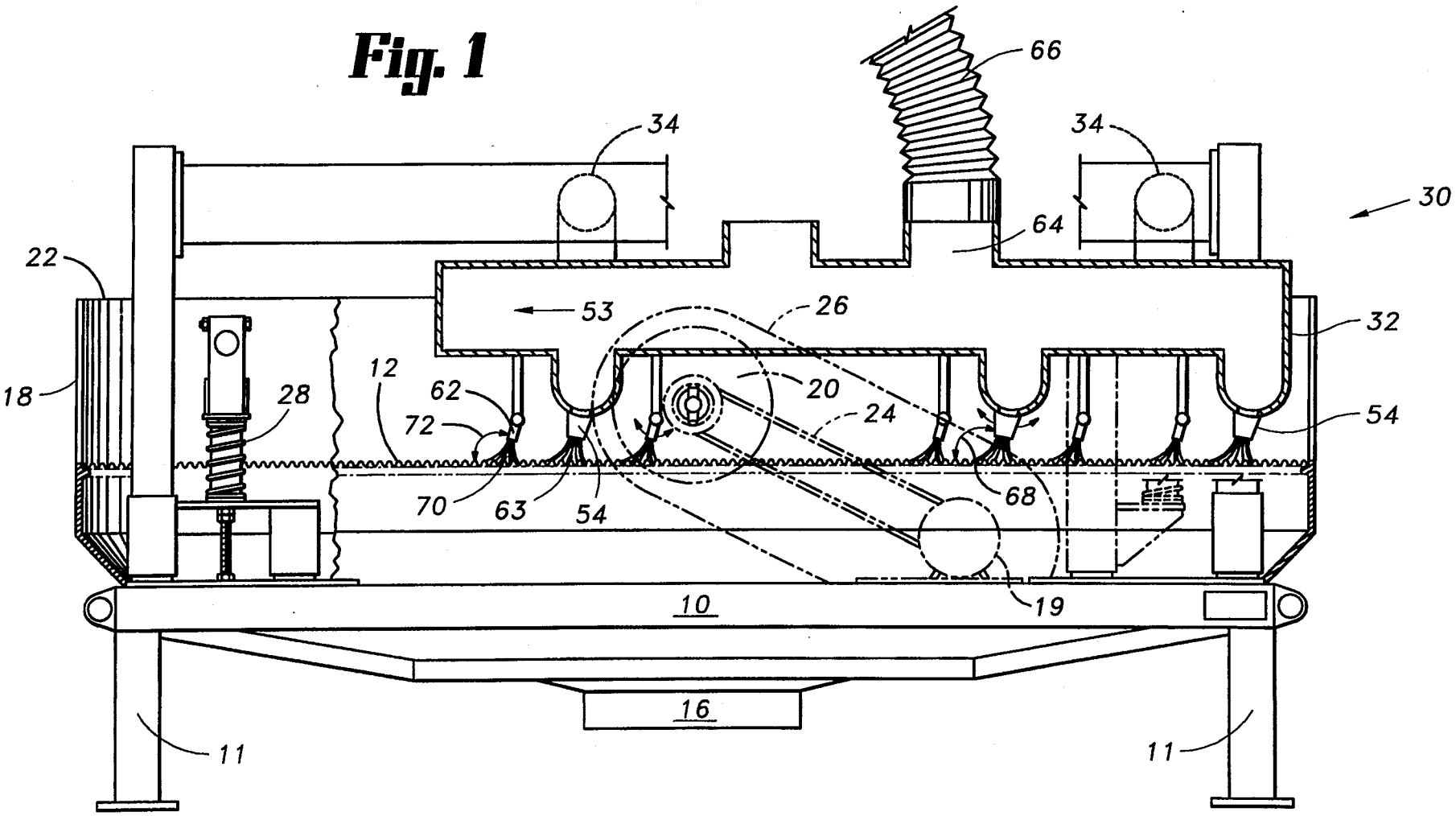
FIG. 1 is a schematic illustration of a screen separator with a traveling manifold, angled feed nozzles, and angled spray nozzles.

Turning in detail to the drawings, FIG. 1 illustrates a screen separator system employing a schematically illustrated vibratory screening system and a traveling influent manifold. The separator system is supported on a base 10. The base 10 has four legs 11 whereby the separator system is suspended to a height appropriate for the processing for which the machine is designed. In the preferred embodiment, the screen 12 is a flat, and rectangular, wire mesh, but it can be circular as well. Below the screen 12 is an outlet 16 through which material passing through the screen 12 is discharged from the system. The vibratory housing 22 has three walls and is open at the screen's discharge end 18 to allow material to flow off the screen 12.

To aid the material in passage over and through the screen 12, the screen 12 is vibrated. Power is transmitted from a motor 19 to an eccentric weight system 20 by a chain or belt 24 which is enclosed in a housing 26. The eccentric weight system 20 is rotatably mounted to the vibratory housing 22. The vibration is isolated by springs 28 which mount the vibratory housing 22 to the base 10. The springs 28 are connected to the base 10 which is stable and to the vibratory housing 22, thereby isolating the vibration. The screen 12 is held by the vibratory housing 22. Thus, the vibration is transferred to the screen 12. In the preferred embodiment, the screen 12 is approximately four feet by nine feet and has a mesh of 120 TBC. However, the screen 12 may have a mesh anywhere in the range of 60 TBC to 325 TBC.

Figure 2:
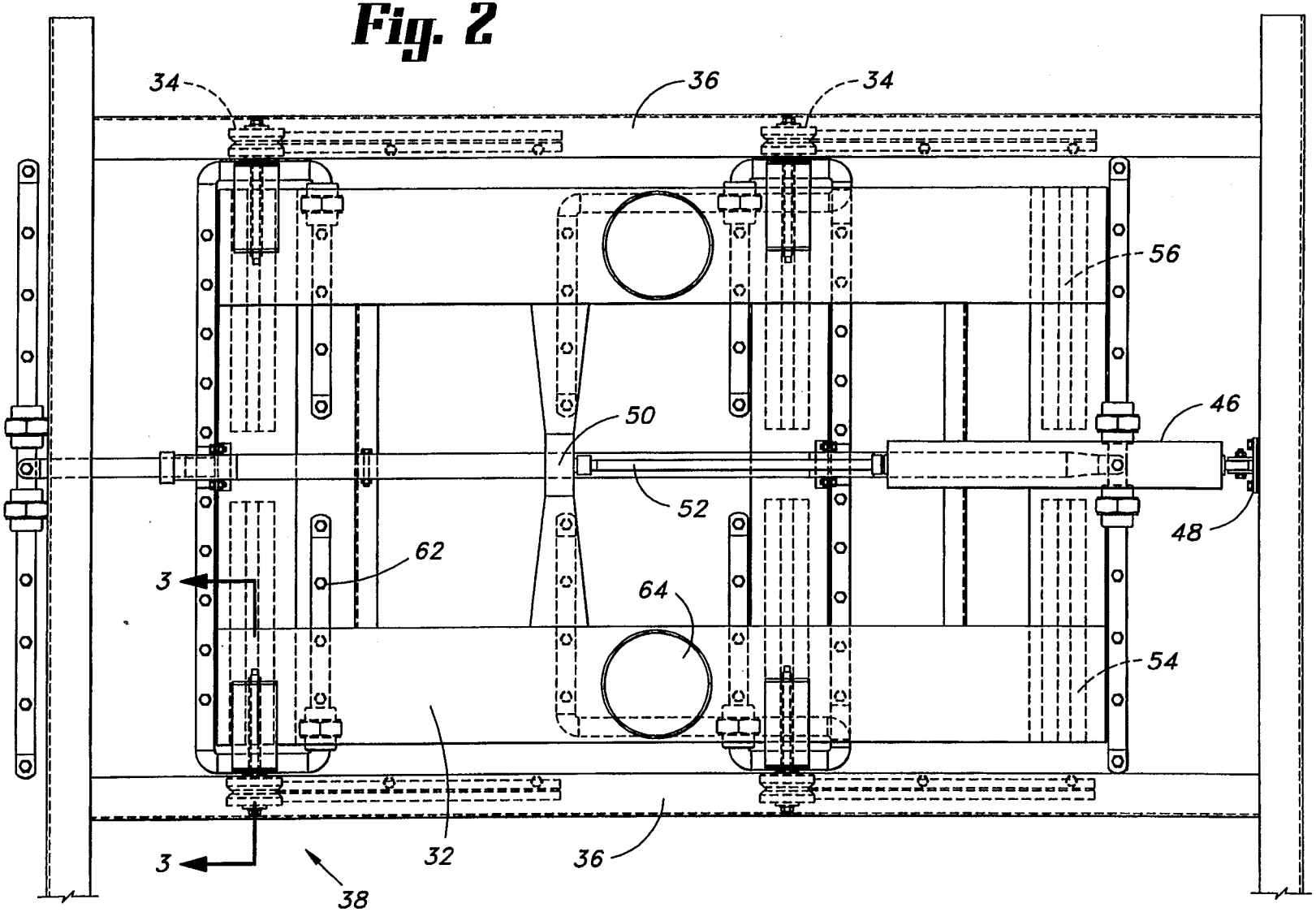
FIG. 2 is a top view of the feeder and manifold.

The feeder, generally designated 30, rests directly on the base 10. The feeder 30 includes a manifold 32 above the screen 12. FIG. 2 illustrates the manifold 32 attached to the feeder structure 30 by four wheels 34 inserted into channels 36 of the feeder 30. The travel of the manifold 32 is directed by a guide way.

Figure 3:
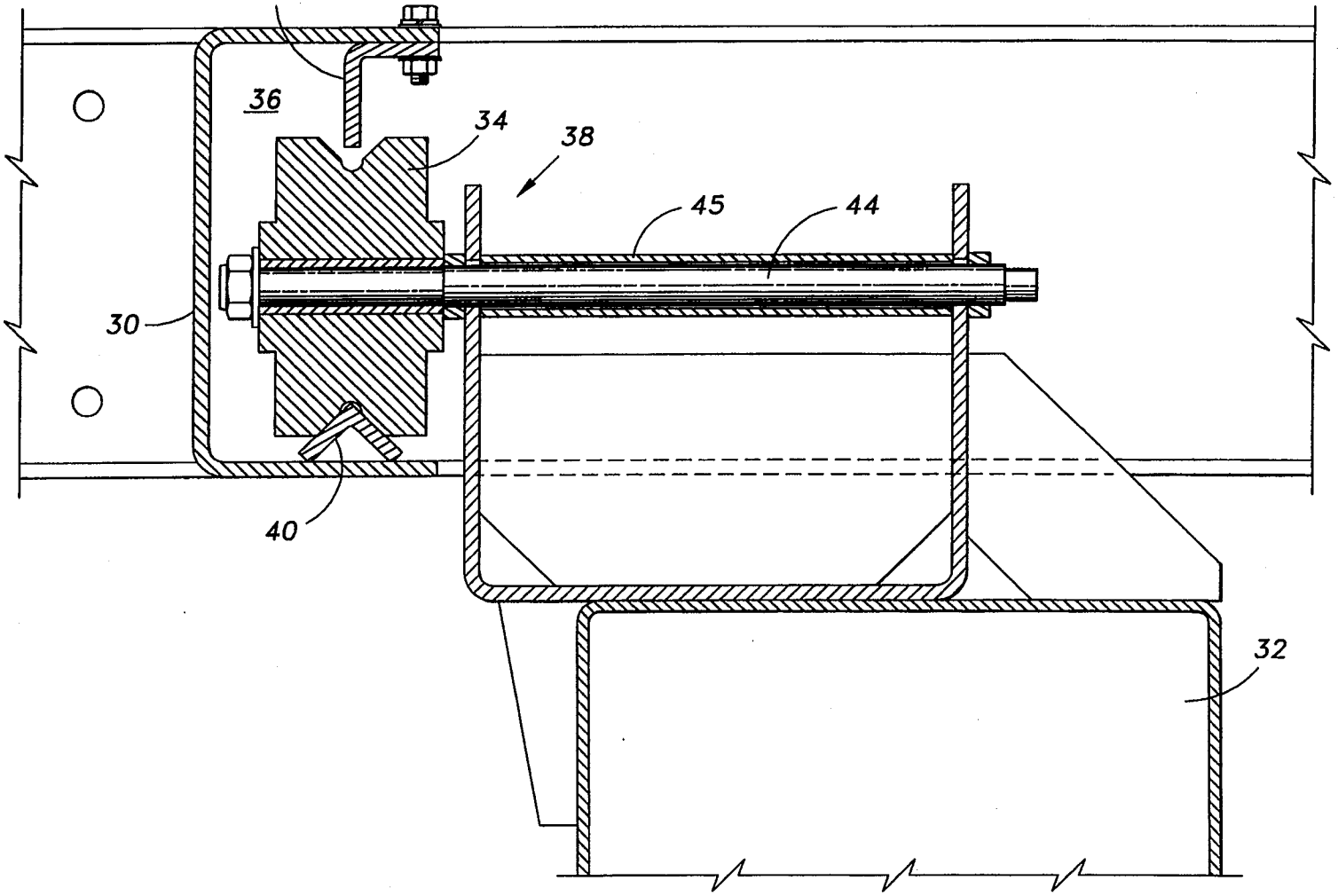
FIG. 3 is a cross-sectional view taken along line 3—3 of FIG. 2 illustrating the wheel mechanism of the manifold and feeder.

FIG. 3 is a cross-sectional view of the preferred embodiment of the guide way wheel assembly, generally designated 38. The wheels 34 roll back and forth on a track 40 and are kept on the track 40 by a guide 42. The track 40 and guide 42 are attached to the feeder structure 30 inside the channel 36, and the wheel shaft 44 is inserted into a manifold bushing 45.

FIG. 2 also illustrates a pneumatic cylinder 46 which operatively connects the manifold 32 to the feeder 30. The pneumatic cylinder 46 connects to the feeder structure 30 at 48 and to the manifold 32 at 50. As the cylinder rod 52 is moved in and out of the cylinder 46, the manifold 32 moves back and forth. Though a pneumatic cylinder 34 is preferred, other motion devices can be used as the feeder drive.

The manifold 32 travels at a rate such that material does not build up on the screen 12. In the preferred embodiment, the manifold 32 moves at a rate between ½ ft/sec and two ft/sec. Though in the preferred embodiment the manifold maintains a substantially constant rate with deviations for change of direction and other factors, the manifold 32 may move at a different rate forward than it does backward. The forward travel, designated by the arrow 53 in FIG. 1, of the manifold 32 toward the discharge end 18 helps float the component of the material passing over the screen 12 to the discharge end 18. By slowing the rate of the forward travel 53, material may be swept forward rather than overrun. Therefore, the component of the material floating over the screen 12 is more efficiently floated to the discharge end 18.

Figure 4:
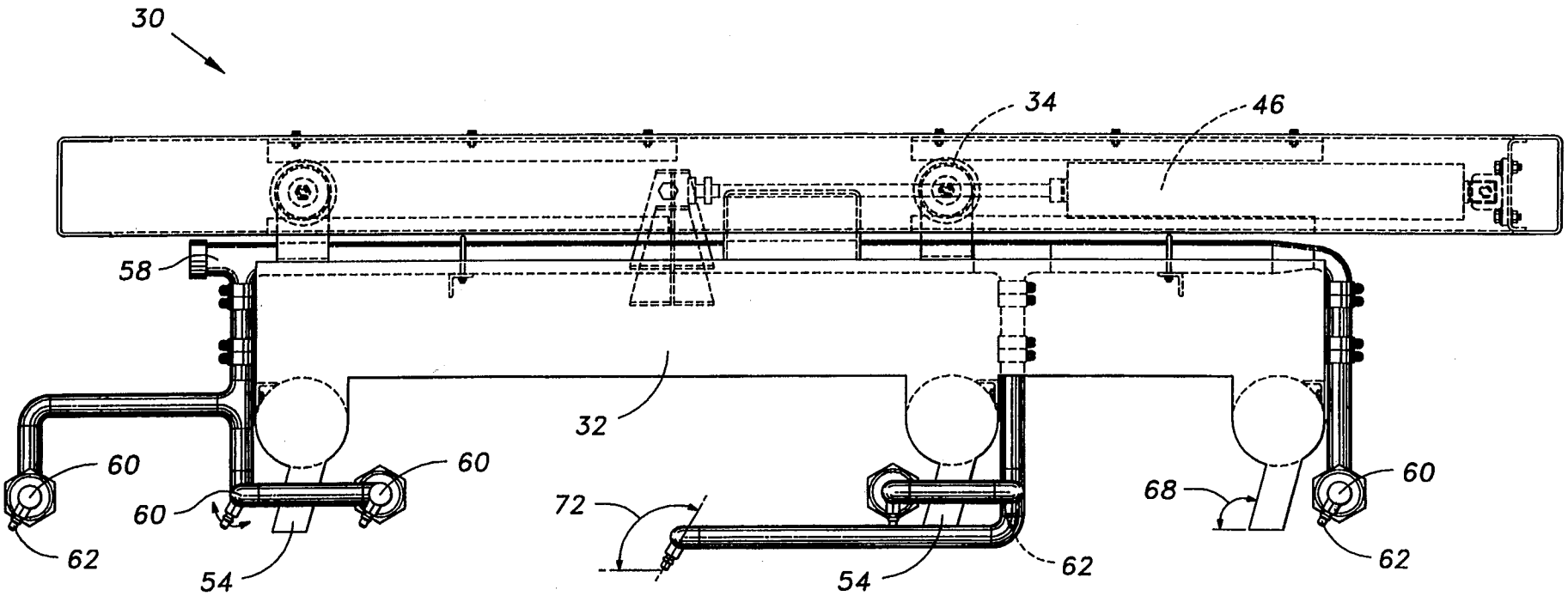
FIG. 4 is a side view of the feeder and manifold.
Figure 5:
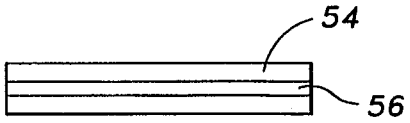
FIG. 5 is a bottom view of the feed nozzle.

Referring to FIG. 4, attached to the bottom of the manifold 32 are feed nozzles 54. The bottom view of a feed nozzle 54 is illustrated in FIG. 5. In the preferred embodiment, the feed nozzles are rectangular with an orifice 56 which extends across their entire length. The width of the orifice 56 may be adjustable by moving one side of the orifice 56 as a plate toward or away from the other side. In the preferred embodiment, the range is from ½ inch to two inches.

Figure 6:
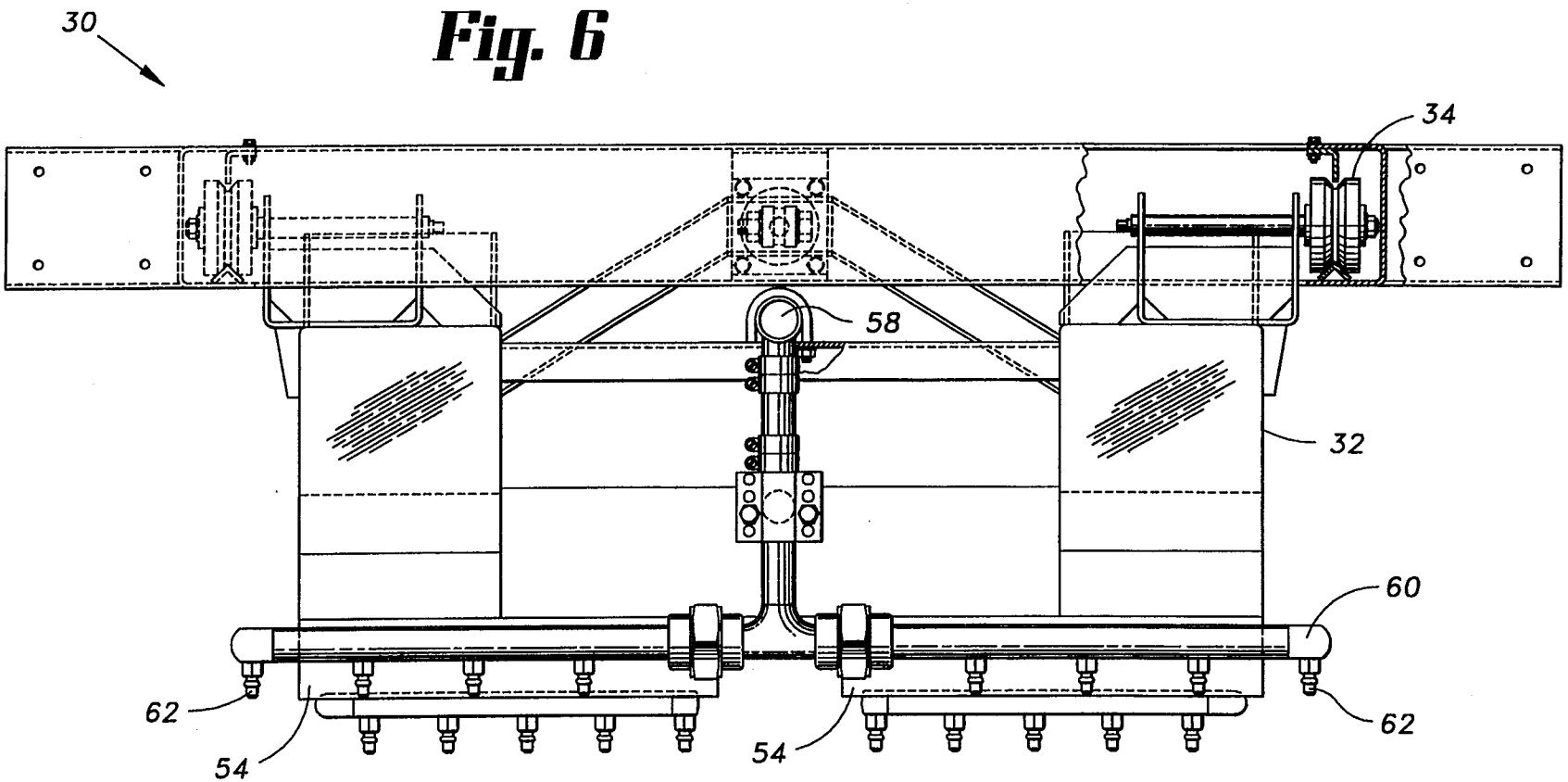
FIG. 6 is an end view of the feeder and manifold.

The screen cleaning system is best illustrated by FIG. 4. A cleaning fluid is distributed by the spray bar manifold 58, to the spray bars 60, and then to the spray nozzles 62 which are attached to the manifold 32. The spray nozzles 62 are positioned before and after every feed nozzle 54. Further, the angle 72 of the spray nozzles 62 can be adjusted. By having spray nozzles 62 before and after every feed nozzle 54, the feed nozzles 54 propel the material to be separated at a clean feed point on the screen 12. FIG. 6 shows an end view of the manifold 32 and feeder 30. The spray nozzles 62 extend wider than the feed nozzles 54 to further facilitate cleaning the screen 12.

Referring again to FIG. 1, the feeder is mounted above the vibratory screen, and the traveling manifold is movably attached to the feeder. The material 63 to be separated is fed into the manifold inlets 64 by the feeder tube 66. The material 63 is then distributed by the manifold 32 to the attached feed nozzles 54. The material 63 is directed by the feed nozzles 54 at an angle, shown generally at 68, toward the discharge end 18. As the material 63 to be separated is propelled at the screen 12, part of the material 63 passes through the screen 12 to the outlet 16 while another part of the material 63 migrates on the screen 12 to the discharge end 18. The spray nozzles 62 direct a cleaning fluid 70 at an angle, shown generally at 72, also toward the discharge end 18. Having both the feed nozzles 64 and the spray nozzles 62 angled toward the discharge end 18 facilitates the quick removal of the component of the material remaining on the screen 12. The angles 72 & 68 of the spray nozzles 62 and the feed nozzles 54 are set large enough to aid the floating of the material toward the discharge end 18. In the preferred embodiment, the angle 68 made by the feed nozzle 54 with the screen 12 may vary from 135° to 160°. The spray nozzles 62 operate at a pressure sufficient to move the component of the substances passing over the screen 12 to the discharge end 18. In the preferred embodiment, the pressure is from 90 psi to 150 psi. By adjusting the size of the feed nozzle orifice 56, the feed velocity can be set between 4 ft/sec–15 ft/sec.

When the material to be separated is treated water from papermaking machines, flow rates from 1000 GPM to 3000 GPM are possible. With a screen mesh of 120 TBC and a feed fiber content of less than 50 ppm, the flow rate would be approximately 3000 GPM. With a screen mesh of 120 TBC and a feed fiber content of 200 ppm to 500 ppm, the flow rate would be approximately 1000 GPM.

Thus, a separator screen system is disclosed which employs a moving manifold, angled spray nozzles, and angled feed nozzles to increase flow rates and separator screen life. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A separator comprising a vibratory screen;

a feeder positioned above said vibratory screen, said feeder including a guide way, a manifold movably mounted on said guide way and having a plurality of feed nozzles directed toward said screen, and a feeder drive coupled to said manifold to move said manifold along said guide way.

2. The separator of claim 1 wherein said vibratory screen includes a taut screen cloth, a discharge at one side of said screen cloth, resilient mounting supporting said screen cloth and a vibratory drive coupled to said screen cloth.

3. The separator of claim 2 wherein said feed nozzles are directed toward said screen cloth with said manifold at any position along said guide path.

4. The separator of claim 1 wherein said guide way includes parallel tracks, said manifold having wheels rotatably mounted thereon positioned on said tracks.

5. The separator of claim 1 wherein said feeder drive includes a piston and cylinder fixed at one end to said manifold and fixed at the other end relative to said vibratory screen.

6. The separator of claim 1, said vibratory screen including a discharge, said feed nozzles being positioned at varying distances from said discharge relative to one another.

7. The separator of claim 6, each said feed nozzle having a substantially rectangular orifice.

8. The separator of claim 6, each said feed nozzle being inclined toward said discharge.

9. The separator of claim 1, each said feed nozzle having a substantially rectangular orifice.

10. The separator of claim 1, said vibratory screen including a discharge, said feed nozzles being inclined toward said discharge.

11. A separator comprising a vibratory screen;

a feeder positioned above said vibratory screen, said feeder including a guide way, a manifold movably mounted on said guide way and having a plurality of feed nozzles directed toward said screen, a plurality of spray nozzles directed toward said screen and a feeder drive coupled to said manifold to move said manifold along said guide way.

12. The separator of claim 11 wherein said vibratory screen includes a taut screen cloth, a discharge at one side of said screen cloth, resilient mounting supporting said screen cloth and a vibratory drive coupled to said screen cloth.

13. The separator of claim 11 wherein said feeder drive moves said manifold back and forth at between one-half foot per second and five feet per second inclusive.

14. A method for screening liquid, comprising the steps of vibrating a screen;

distributing influent with back and forth movement onto the vibrating screen;

spraying clear water with the same back and forth movement onto the vibrating screen adjacent the influent such that both the influent and the clear water are presented to the same areas of the screen seriatim.

15. The method of claim 14 wherein said back and forth movement is toward and away from a discharge on the vibrating screen, the movement toward being slower than the movement away.

16. A separator comprising a vibratory screen including a taut screen cloth, a discharge at one side of said screen cloth, resilient mounting supporting said screen cloth and a vibratory drive coupled to said screen cloth;

a feeder positioned above said vibratory screen, said feeder including a guide way, a manifold movably mounted on said guide way and having a plurality of feed nozzles, and a feeder drive coupled to said manifold to move said manifold along said guide way, said feed nozzles being directed toward said screen cloth with said manifold at any position along said guide way and each said feed nozzle having a substantially rectangular orifice extending parallel to and inclined toward said discharge.

17. The separator of claim 16 wherein said feed nozzles make an angle of 135° to 160° inclusive with said screen cloth.

18. The separator of claim 16 wherein said manifold includes a plurality of rows of feed nozzles mutually spaced apart above said screen.

19. The separator of claim 18 wherein said rows each include a plurality of rectangular orifices arranged in a line.

20. The separator of claim 19 wherein said screen cloth and said guide way are substantially horizontal.

21. A separator comprising a vibratory screen including a taut screen cloth, a discharge at one side of said screen cloth, resilient mounting supporting said screen cloth and a vibratory drive coupled to said screen cloth; and a feeder positioned above said vibratory screen, said feeder including a guide way, a manifold movably mounted on said guide way and having a plurality of feed nozzles directed toward said screen, a plurality of spray nozzles directed toward said screen and a feeder drive coupled to said manifold to move said manifold along said guide way, said feed nozzles and said spray nozzles being directed toward said screen cloth and inclined toward said discharge with said manifold at any position along said guide way.

22. The separator of claim 21 wherein said feed nozzles and said spray nozzles make an angle of 135° to 160° inclusive with said screen cloth.

23. The separator of claim 21 wherein said feed nozzles and said spray nozzles are arranged in separate parallel rows.

24. The separator of claim 23 wherein said spray nozzles provide a pressurized clear water cleaning spray and said feed nozzles provide a lower pressure influent feed.

25. The separator of claim 24 wherein said spray nozzles cover substantially the entire screen cloth with full travel of said manifold.

26. A separator comprising:

a vibratory screen having a discharge;

a feeder positioned above said vibratory screen, said feeder including a guide way, and a manifold movably mounted on said guide way and having a plurality of feed nozzles directed toward said screen, a plurality of spray nozzles directed toward said screen and a feeder drive coupled to said manifold to move said manifold along said guide way, said feed nozzles and said spray nozzles being directed towards said screen cloth and inclined toward said discharge with said manifold at any position along said guide way.

* * * * *